US006195836B1

(12) United States Patent
Vanderlinden

(10) Patent No.: US 6,195,836 B1
(45) **Date of Patent: *Mar. 6, 2001**

(54) MECHANICAL SURFACE CLEANING VEHICLE FOR FINE PARTICULATE REMOVAL

(76) Inventor: Roger P. Vanderlinden, 73 Sherman Avenue S., Hamilton, Ontario (CA), L8M 2P8

( * ) Notice: Subject to any disclaimer, the term of this patent is extended or adjusted under 35 U.S.C. 154(b) by 0 days.

This patent is subject to a terminal disclaimer.

(21) Appl. No.: 09/371,530

(22) Filed: Aug. 10, 1999

Related U.S. Application Data

(63) Continuation-in-part of application No. 09/253,746, filed on Feb. 22, 1999, now abandoned.

(51) Int. Cl.[7] ..... A47L 5/14

(52) U.S. Cl. ..... 15/340.3; 15/346; 15/348; 15/349

(58) Field of Search ..... 15/340.3, 346, 15/348, 349

(56) References Cited

U.S. PATENT DOCUMENTS

| | | | | |
|---|---|---|---|---|
| 1,207,816 | * | 12/1916 | Thompson | 15/346 |
| 1,610,119 | * | 12/1926 | Butler | 15/348 |
| 4,457,044 | * | 7/1984 | Erdman et al. | 15/348 |
| 4,754,521 | * | 7/1988 | Zoni | 15/348 |
| 4,858,270 | * | 8/1989 | Boschung | 15/346 |
| 4,951,347 | * | 8/1990 | Star et al. | 15/340.3 |
| 5,303,448 | * | 4/1994 | Hennessey et al. | 15/340.3 |
| 5,542,148 | * | 8/1996 | Young | 15/346 |
| 5,794,304 | * | 8/1998 | Ritter | 15/346 |
| 5,884,359 | * | 3/1999 | Thompson | 15/346 |

* cited by examiner

*Primary Examiner*—Robert J. Warden, Sr.
*Assistant Examiner*—Theresa T. Snider

(57) ABSTRACT

A mechanical surface sweeping vehicle has a cylindrically-shaped rotating sweeping broom to propel forwardly debris disposed on a contacted portion of a surface being cleaned, thereby creating a forwardly propelled stream of debris. A mechanical debris elevator is disposed to receive and retain the forwardly propelled stream of debris and to deposit the received and retained debris into the hopper. A deflector flap is disposed forwardly of the rotating sweeping broom and immediately rearwardly of the debris accepting lower end portion of the mechanical debris elevator, to receive at least a portion of the forwardly propelled stream of debris and to deflect it upwardly and forwardly onto the mechanical debris elevator. An air blast outlet effects a blast of air forcefully impinges in a forward direction the surface behind the leading edge of the broom, thereby propelling forwardly therewith fine debris disposed on the surface, and carries forwardly through the sweeping broom and egresses therefrom, to deflect forwardly and upwardly off the deflector flap and forwardly past the deflector flap to travel to the mechanical debris elevator, in a path having a forward component along its entire length, exclusive of subsequent impingement of the surface and exclusive of subsequent re-entry into the lower portion of the broom.

15 Claims, 3 Drawing Sheets

MECHANICAL SURFACE CLEANING VEHICLE FOR FINE PARTICULATE REMOVAL

CROSS REFERENCE

This application is a Continuation-In-Part of application Ser. No. 09/253,746, filed Feb. 22, 1999 now abandoned.

FIELD OF THE INVENTION

The present invention relates to surface cleaning vehicles such as street sweeping vehicles and factory floor sweeping vehicles, and more particularly to such surface cleaning vehicles that employ air to remove small particulate matter from the surface being cleaned.

BACKGROUND OF THE INVENTION

The removal of dirt and debris from streets, parking lots, airport runways, factory floors, and other similar paved surfaces, through the use of various types of street cleaning vehicles or factory sweeping vehicles, as may be the case, has been known for many years. For the sake of brevity, clarity and simplicity, such vehicles will be generally referred to in this document as surface cleaning vehicles.

One type of conventional surface cleaning vehicle is known as a surface sweeping vehicle, commonly referred to as a "sweeper". In a mechanical surface sweeping vehicle, a pair of counter-rotating disc type brushes, commonly called gutter brooms, sweep dirt and debris inwardly to underneath the central area of the sweeper and an elongate cylindrically-shaped sweeping broom that rotates about a horizontal axis sweeps the dirt and debris onto a conveyor. The conveyor deposits the dirt and debris into a hopper for subsequent controlled dumping from the hopper. Such sweepers can remove large amounts of dirt and debris from a paved surface quite quickly and thoroughly, and can generally remove large pieces of debris quite readily. However, they cannot remove dirt and debris from significant depressions, cannot thoroughly clean a paved surface, cannot clean out a porous surface and cannot effectively remove fine particulate matter from a surface.

It is an object of the present invention to provide a surface cleaning vehicle that employs a mechanical debris loading means and that sweeps the surface with a sweeping broom first and then cleans small particulate matter from the surface.

It is another object of the present invention to provide a surface cleaning vehicle that employs a mechanical debris loading means and that sweeps the surface with a sweeping broom first and then cleans small particulate matter from the surface, without the use of water for dust suppression.

It is another object of the present invention to provide a surface cleaning vehicle that employs a mechanical debris loading means and that can clean depressions and cracks.

SUMMARY OF THE INVENTION

In accordance with one aspect of the present invention, there is provided a novel mechanical surface cleaning vehicle having a front end, a back end, a debris retaining hopper, and defining a medial longitudinal axis "L". The surface cleaning vehicle comprises a cylindrically-shaped rotating sweeping broom of width "$W_B$" mounted on the vehicle for rotation about a horizontal axis of rotation and to propel forwardly from a surface contacting segment debris disposed on a contacted portion of a surface being cleaned, the contacted portion being defined at its front by a leading edge, thereby creating a forwardly propelled stream of debris. A mechanical debris elevating means is mounted on the vehicle to receive and retain the forwardly propelled stream of debris and deposit the received and retained debris into the hopper. A deflector flap means is disposed forwardly of the rotating sweeping broom and adjacent the debris accepting lower end portion of the mechanical debris elevating means, to receive at least a portion of the forwardly propelled stream of debris and to deflect it upwardly and forwardly onto the mechanical debris elevating means. An air blast generating means is for effecting a blast of air that forcefully impinges the surface behind the leading edge, thereby propelling forwardly therewith fine debris disposed on the surface, and that carries forwardly through the rotating sweeping broom and egresses therefrom, to deflect forwardly and upwardly off the deflector flap means and forwardly past the deflector flap means to the mechanical debris elevating means.

In accordance with another aspect of the present invention, there is provided a novel mechanical surface cleaning vehicle having a front end, a back end, a debris retaining hopper, and defining a medial longitudinal axis "L". The surface sweeping vehicle comprises a cylindrically-shaped rotating sweeping broom of width "$W_B$" mounted on the vehicle for rotation about a horizontal axis of rotation and to propel forwardly from a surface contacting segment debris disposed on a contacted portion of a surface being cleaned, the contacted portion being defined at its front by a leading edge, thereby creating a forwardly propelled stream of debris. A mechanical debris elevating means is mounted on the vehicle to receive and retain the forwardly propelled stream of debris and to deposit the received and retained debris into the hopper. An air blast generating means is for effecting a blast of air that forcefully impinges the surface behind the leading edge of the contacted portion thereby propelling forwardly therewith fine debris disposed on the surface, and that carries through the rotating sweeping broom and egresses therefrom to the mechanical debris elevating means, exclusive of subsequent re-entry into the lower portion of the rotating sweeping broom below the horizontal axis of rotation prior to reaching the mechanical debris elevating means.

In accordance with another aspect of the present invention, there is provided a novel mechanical surface cleaning vehicle having a front end, a back end, a debris retaining hopper, and defining a medial longitudinal axis "L". The surface sweeping vehicle comprises a cylindrically-shaped rotating sweeping broom of width "$W_B$" mounted on the vehicle for rotation about a horizontal axis of rotation and to propel forwardly from a surface contacting segment debris disposed on a contacted portion of a surface being cleaned, the contacted portion being defined at its front by a leading edge, thereby creating a forwardly propelled stream of debris. A mechanical debris elevating means is mounted on the vehicle to receive and retain the forwardly propelled stream of debris and to deposit the received and retained debris into the hopper. An air blast generating means is for effecting a blast of air that forcefully impinges the surface behind the leading edge of the contacted portion thereby propelling forwardly therewith fine debris disposed on the surface, and that carries through the rotating sweeping broom and egresses therefrom to the mechanical debris elevating means, exclusive of subsequent impingement of the surface prior to reaching the mechanical debris elevating means.

In accordance with another aspect of the present invention, there is provided a novel mechanical surface cleaning vehicle having a front end, a back end, a debris retaining hopper, and defining a medial longitudinal axis "L". The surface sweeping vehicle comprises a cylindrically-shaped rotating sweeping broom of width "$W_B$" mounted on the vehicle for rotation about a horizontal axis of rotation and to propel forwardly from a surface contacting segment debris disposed on a contacted portion of a surface being cleaned, the contacted portion being defined at its front by a leading edge, thereby creating a forwardly propelled stream of debris. A mechanical debris elevating means is mounted on the vehicle to receive and retain the forwardly propelled stream of debris and to deposit the received and retained debris into the hopper. An air blast generating means having a horizontally elongate air blast outlet of width "$W_O$" is disposed immediately rearwardly of the contacted portion of the surface for effecting a blast of air that forcefully impinges the surface behind the leading edge of the contacted portion thereby propelling forwardly therewith fine debris disposed on the surface, and that carries forwardly through the rotating sweeping broom and egresses therefrom, to the mechanical debris elevating means.

In accordance with yet another aspect of the present invention, there is provided a novel mechanical surface cleaning vehicle having a front end, a back end, a debris retaining hopper, and defining a medial longitudinal axis "L". The surface sweeping vehicle comprises a cylindrically-shaped rotating sweeping broom of width "$W_B$" mounted on the vehicle for rotation about a horizontal axis of rotation and to propel forwardly from a surface contacting segment debris disposed on a contacted portion of a surface being cleaned, the contacted portion being defined at its front by a leading edge, thereby creating a forwardly propelled stream of debris. A mechanical debris elevating means is mounted on the vehicle to receive and retain the forwardly propelled stream of debris and to deposit the received and retained debris into the hopper. An air blast generating means is for effecting a blast of air that forcefully impinges the surface behind the leading edge of the contacted portion thereby propelling forwardly therewith fine debris disposed on the surface, and that carries forwardly through the rotating sweeping broom and egresses therefrom, and travels in a path having a forward component along its entire length, to the mechanical debris elevating means.

In accordance with still another aspect of the present invention, there is provided a novel mechanical surface cleaning vehicle having a front end, a back end, a debris retaining hopper, and defining a medial longitudinal axis "L". The surface sweeping vehicle comprises a cylindrically-shaped rotating sweeping broom of width "$W_B$" mounted on the vehicle for rotation about a horizontal axis of rotation and to propel forwardly from a surface contacting segment debris disposed on a contacted portion of a surface being cleaned, the contacted portion being defined at its front by a leading edge, thereby creating a forwardly propelled stream of debris. A mechanical debris elevating means is mounted on the vehicle with a debris accepting lower end portion disposed to receive and retain the forwardly propelled stream of debris, and with an upper end portion disposed in debris depositing relation to the hopper. An air blast generating means is for effecting a blast of air that forcefully impinges in a substantially forward direction the surface behind the leading edge of the contacted portion, thereby propelling forwardly therewith debris disposed on the surface, and that carries through the rotating sweeping broom and egresses therefrom, to the mechanical debris elevating means.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the mechanical surface cleaning vehicle according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
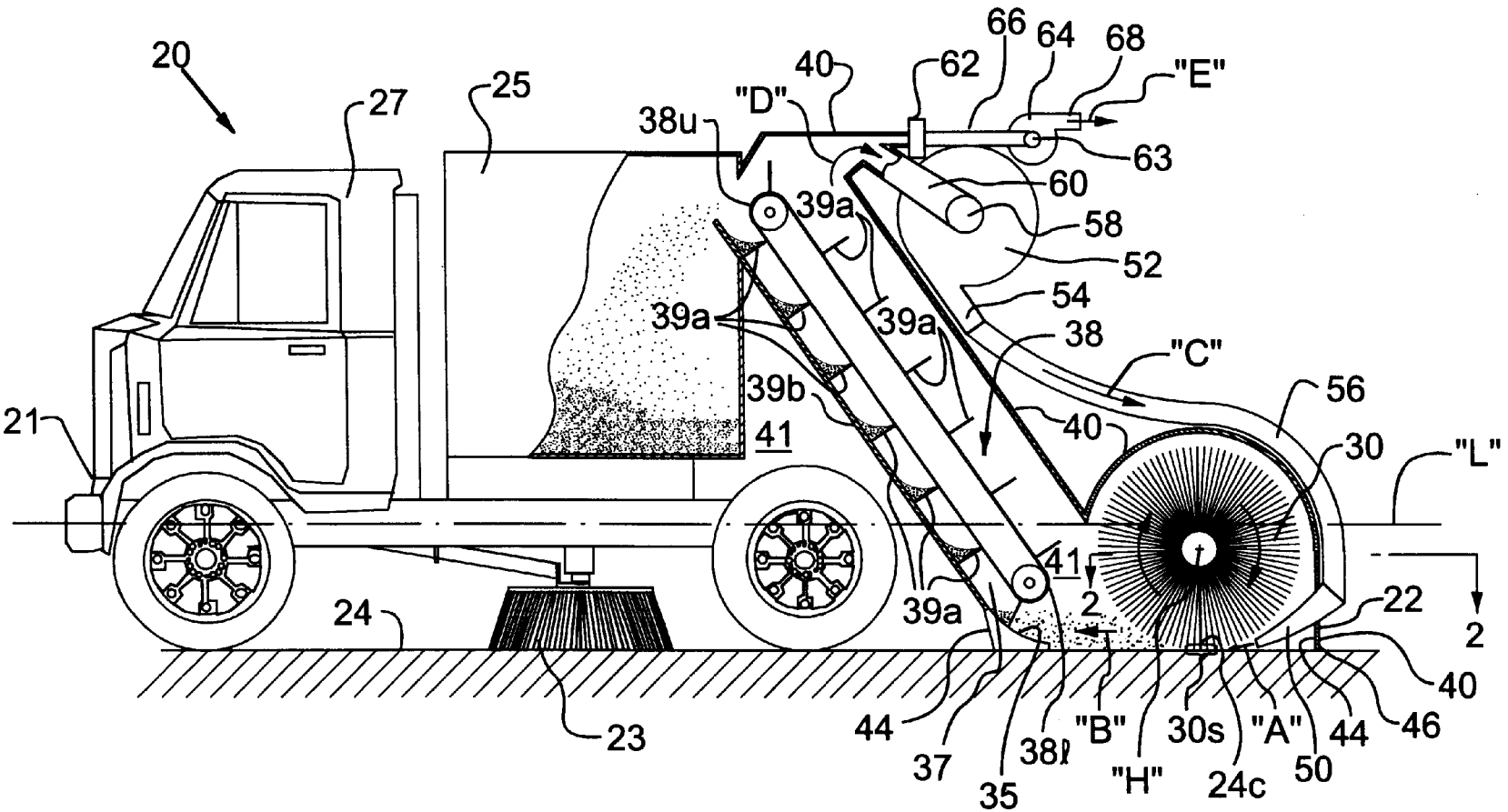
FIG. 1 is a side elevational view of a first preferred embodiment of the surface cleaning vehicle according to the present invention, with a portion of the side of the surface cleaning vehicle removed for the sake of clarity.
Figure 2:
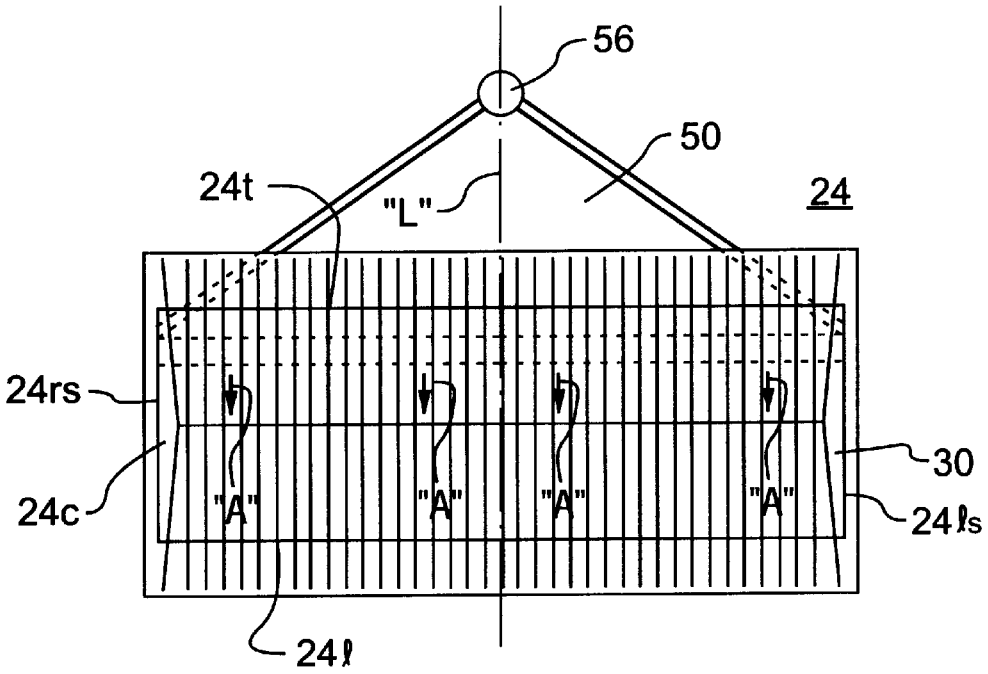
FIG. 2 is a sectional top plan view of a portion of the first preferred embodiment surface cleaning vehicle of FIG. 1, taken along section line 2—2; and, FIG. 3 is a back end elevational view of a portion of the first preferred embodiment surface cleaning vehicle of FIG. 1, showing air blast chute, but with the broom cover shroud omitted for the sake of clarity.
Figure 3:
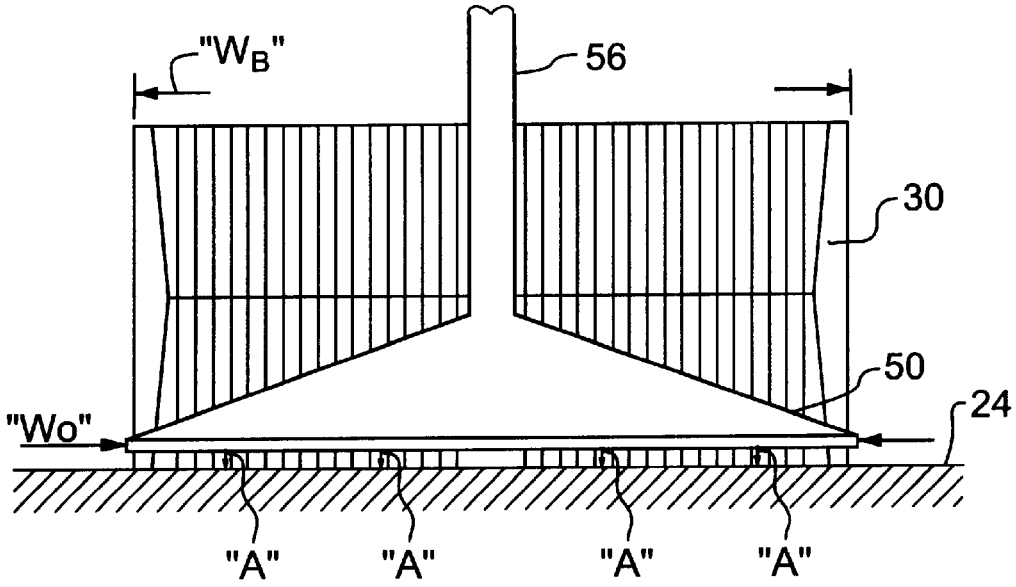

Reference will now be made to FIGS. 1 through 3, which show a first preferred embodiment of the surface cleaning vehicle of the present invention, as indicated by general reference numeral 20. The surface cleaning vehicle 20 has a front end 21 and a back end 22 and a generally centrally disposed longitudinal axis "L" extending between said front and back ends 21,22. A debris retaining hopper 25 is mounted on the surface cleaning vehicle 20 immediately behind the cab 27.

Two conventional counter-rotating brushes 23 (only one shown) are mounted on the surface cleaning vehicle 20 to brush debris from a surface 24 being cleaned, such as a road surface, and to brush debris away from curbs and the like. In any event, the debris is brushed inwardly toward the generally centrally disposed longitudinal axis "L".

A cylindrically-shaped rotating sweeping broom 30 of width "$W_B$" is mounted on the surface cleaning vehicle 20 mounting arms (not shown) so as to be disposed laterally across the longitudinal axis "L", of the street cleaning vehicle 20, for selective rotation about a substantially horizontal axis of rotation "H" by means of suitable bearings (not shown) in road tracking relation, or in other words, to have a surface contacting segment 30*s*, that engages in sweeping relation a contacted portion 24*c* of the surface 24 being cleaned, and to propel forwardly debris disposed on the contacted portion 24*c* of the surface 24 being cleaned, thereby creating a forwardly propelled stream of debris. The contacted portion 24*c* is defined by a leading edge 24*t*, a trailing edge 24*l*, a left side edge 24*ls*, and a right side edge 24*rs*.

In the first preferred embodiment as illustrated, a mechanical debris elevating means 38 comprises a mechanical debris elevator, and has a debris accepting lower end portion 38*l* and an upper end portion 38*u*. The mechanical debris elevator 38 is mounted on the street cleaning vehicle 20 to be disposed rearwardly of the hopper 25 and forwardly of the sweeping broom 30, and is also disposed laterally across the longitudinal axis "L" of the street sweeping vehicle 20, and such that the debris accepting lower end portion 38*l* is disposed immediately forwardly of the rotating sweeping broom 30. In this manner, the mechanical debris elevator 38 is mounted on the surface cleaning vehicle 20 to receive and retain the forwardly propelled stream of debris and to deposit the received and retained debris into the hopper 25. More specifically, the mechanical debris elevator 38 is mounted on the surface cleaning vehicle 20 to receive and retain, at its debris accepting lower end portion 38*l*, the forwardly propelled stream of debris propelled forwardly by the rotating sweeping broom 30, and such that the upper end portion 38*u* is disposed in debris depositing relation to the hopper 25. Debris that is propelled forwardly by the rotating sweeping broom 30 onto the mechanical debris elevator 38 is lifted by elevator paddles 39*a* up an elevator ramp 39*b* and is subsequently deposited into the hopper 25. Alternatively, types of other mechanical debris elevating or lifting means could be used.

A deflector flap means comprising a deflector flap 35 is secured to the bottom end 37 of the elevator ramp 39*b* of the mechanical debris elevator 38 so as to be disposed immediately forwardly of and substantially parallel to the rotating sweeping broom 30, and immediately rearwardly of the debris accepting lower end portion 38*l* of the mechanical debris elevator 38. The deflector flap 35 receives at least a portion of the forwardly propelled stream of debris, and deflects the forwardly propelled stream of debris upwardly and forwardly onto the mechanical debris elevator 38 at its debris accepting lower end portion 38*l*. The deflector flap 35 also substantially precludes the forwardly propelled stream of debris from passing forwardly under the mechanical debris elevator 38. Opposed left and right drag shoes (not shown) are disposed on opposite sides of the longitudinal axis "L" and laterally border the sweeping broom 30 at its lateral ends and also laterally border the ends of the mechanical debris elevator 38.

The surface cleaning vehicle 20 further comprises a plurality of panels, flaps, and seals forming a shroud 40 mounted on the surface cleaning vehicle 20, so as to enclose within its interior 41 the rotating sweeping broom 30, the mechanical debris elevator 38, and seals to the hopper 25. The shroud 40 peripheral bottom skirted edges 44 that substantially seal to the surface 24 being cleaned.

An air blast generating means comprises a horizontally elongate air blast outlet 50 and a main fan 52. The horizontally elongate air blast outlet 50 is mounted on the surface cleaning vehicle 20, so as to terminate in the shroud 40, and so as to be disposed immediately rearwardly of the surface contacting segment 30*s* of the rotating sweeping broom 30, and therefore be disposed immediately rearwardly of the contact portion 24*c* of the surface 24 being cleaned. As can be best seen in FIG. 3, the horizontally elongate air blast outlet 50 has a width "$W_O$" that is substantially coincident with the width "WB" best seen in FIG. 1, the air blast outlet 50 is connected in fluid communication to an air flow supply comprising the main fan 52, so as to receive air therefrom, and to effect a blast of air into the interior 41 of the shroud 40, as will be discussed in greater detail subsequently. Alternatively, an air compressor could be used in place of, or in conjunction with, the main fan 52. In the first preferred embodiment, as illustrated, the main fan 52 is mounted on the surface cleaning vehicle 20 towards the back end 22 thereof. The outlet 54 of the main fan 52 is connected in fluid communication via a flexible pipe 56 with the horizontally elongate air blast outlet 50. The inlet 58 of the main fan 52 is connected in fluid communication to the interior 41 of the shroud 40 through an air supply pipe 60. Further, the inlet 63 of an auxiliary fan 64 is connected in fluid communication to the air supply pipe 60 via an auxiliary pipe 66 through a filter 62, and the outlet 68 of the auxiliary fan 64 is exhausted to the ambient surroundings. The purpose of the auxiliary fan 64 is to reduce the ambient air pressure within the interior 41 of the shroud 40, thus helping to preclude dust from escaping.

Figure 1A:
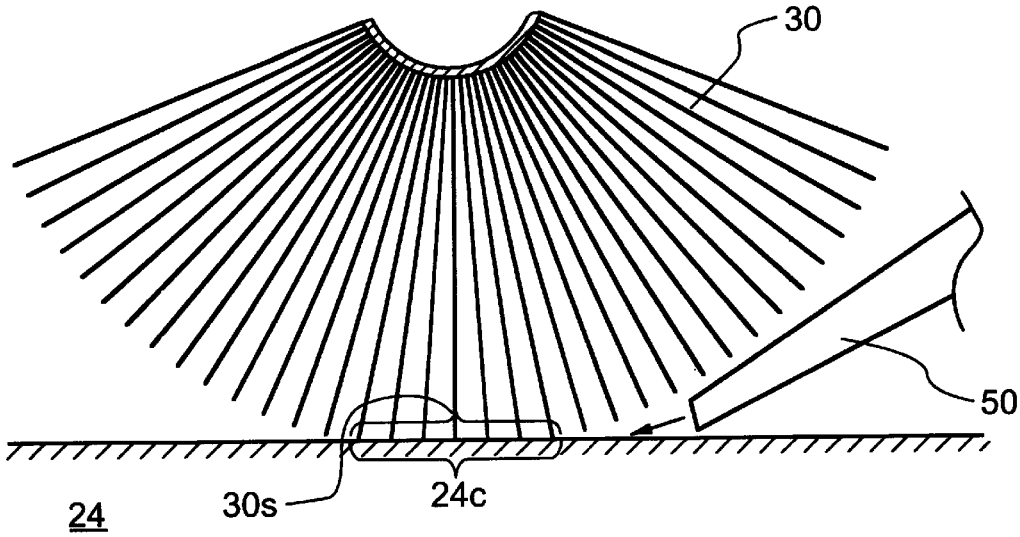
FIG. 1A is an enlarged side elevational view of a portion of the first preferred embodiment surface cleaning vehicle of FIG. 1, with the air blast outlet aimed immediately behind the contacted portion of the surface being cleaned, as contacted by the surface contacting segment of the rotating sweeping broom.
Figure 1B:
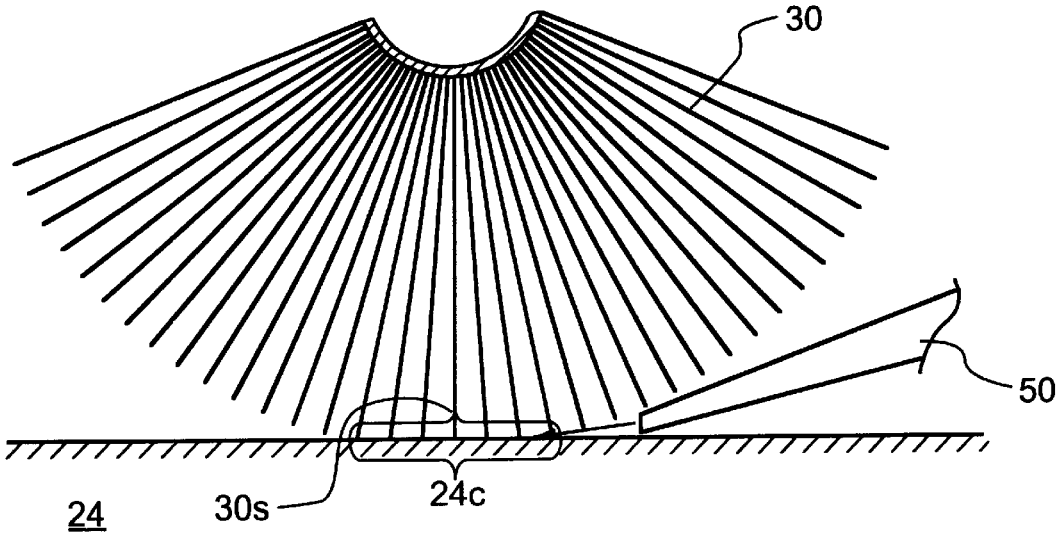
FIG. 1B is an enlarged side elevational view of a portion of the first preferred embodiment surface cleaning vehicle of FIG. 1, with the air blast outlet aimed at the contacted portion of the surface being cleaned, as contacted by the surface contacting segment of the rotating sweeping broom.

The horizontally elongate air blast outlet 50 is positioned immediately rearwardly of the rotating sweeping broom 30 and is oriented to effect a blast of air at the surface 24 behind the leading edge 24*l* in a substantially forward direction. As is shown in FIG. 1A, the air blast outlet 50 is positioned and oriented such that the air blast impinges off a portion of the surface 24 immediately behind the contacted portion 24*c* of the surface 24, which is contacted by the surface contacting segment 30*s* of the rotating sweeping broom 30. As is shown in FIG. 1B, the air blast outlet 50 is positioned and oriented such that the air blast impinges off the contacted portion 24*c* of the surface 24, which is contacted by the surface contacting segment 30*s* of the rotating sweeping broom 30.

In any event, the blast of air thereby propels forwardly therewith fine debris disposed on the surface 24, and continues to flow forwardly and to carry forwardly through the rotating sweeping broom 30 and egresses therefrom. Further, the blast of air carries through the rotating sweeping broom 30 exclusive of subsequent reentry into the lower portion of the rotating sweeping broom 30 below the horizontal axis of rotation "H", and exclusive of subsequent impingement of the surface 24, prior to reaching the mechanical debris elevator 38. In other words, the blast of air from the air blast outlet 50 passes through the lower portion of the rotating sweeping broom 30 once only, and does not carry back rearwardly around the rotating sweeping broom 30. The blast of air thereby propels debris disposed on the surface 24 being cleaned forwardly into the forwardly propelled stream of debris, thus augmenting the cleaning of the surface 24. It can be seen that the cleaning of the surface takes place in the shroud 40.

After the air blast egresses from the rotating sweeping broom 30, it travels in a path having a forward component along its entire length, and it deflects forwardly and upwardly off the deflector flap 35, and continues forwardly past the deflector flap 35, to the mechanical debris elevator 38.

As can be best seen in FIG. 1, the mechanical debris elevator 38 is mounted on the surface cleaning vehicle 20 to receive the forwardly propelled stream of debris propelled forwardly by the rotating sweeping broom 30, as discussed previously, and to receive the debris propelled forwardly by the horizontally elongate air blast outlet 50, as indicated by arrow "B" in FIG. 1.

In use, the surface cleaning vehicle 20 travels forwardly and debris passes under the drag flap 35 and under the mechanical debris elevator 38, and is then swept forwardly by the rotating sweeping broom 30 onto the mechanical debris elevator 38. Any fine particle debris, or in other words dust, that is missed by the rotating sweeping broom 30 is blown forwardly through the broom by the horizontally elongate air blast outlet 50, as is best seen in FIGS. 1 through 3. The horizontally elongate air blast outlet 50 receives air from the main fan 52 through the flexible pipe 56, as indicated by arrow "C" in FIG. 1. The main fan 52, in turn, draws air from the interior 41 of the shroud 40 immediately to the rear of the hopper 25, as indicated by arrow "D" in FIG. 1. The auxiliary fan 64 exhausts a portion of the air drawn from the interior 41 of the shroud 40 to the atmosphere, as indicated by arrow "E" in FIG. 1, in order to have a negative pressure within the shroud 40, thus precluding dust from being blown past the surface contacting skirt 46 and out of the shroud 40.

Alternatively, it is contemplated that in the mechanical surface cleaning vehicle according to the present invention, the air flow supply that is connected in fluid communication to the air blast outlet could comprise an air compressor, or could comprise both a fan and an air compressor.

As can be understood from the above description and from the accompanying drawings, the mechanical surface cleaning vehicle according to the present invention achieves the combined advantages of conventional prior art mechanical surface sweeping vehicles and recirculating air type surface cleaning vehicles, which is otherwise unknown in the industry. The present surface cleaning vehicle sweeps the surface with a sweeping broom and loads into a mechanical debris elevator, and cleans small particulate matter from the surface, without the use of water for dust suppression. Accordingly, end results are achieved, in terms of cleaning a surface such as a street, which end results cannot be achieved by conventional prior art surface sweeping or cleaning vehicles. Specifically, the mechanical surface cleaning vehicle according to the present invention is the only surface cleaning that can clean heavy debris at a satisfactory travel speed and can simultaneously clean fine debris, such as dust, without the aid of water for dust suppression. Further, the present mechanical surface cleaning vehicle uses very significantly less air than do prior art recirculating air type surface cleaning vehicles, since the debris is being moved mostly by the rotating sweeping broom, and thus uses air far more efficiently. Accordingly, the present mechanical surface cleaning vehicle is less noisy than prior art recirculating air type surface cleaning vehicles, and experiences less wear than prior art recirculating air type surface cleaning vehicles.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A mechanical surface cleaning vehicle having a front end, a back end, a debris retaining hopper, and defining a medial longitudinal axis (L), said surface cleaning vehicle comprising:

a cylindrically-shaped rotating sweeping broom of width ($W_B$) mounted on said vehicle for rotation about a horizontal axis of rotation and to propel forwardly from a surface contacting segment debris disposed on a contacted portion of a surface being cleaned, said contacted portion being defined at its front by a leading edge, thereby creating a forwardly propelled stream of debris;

mechanical debris elevating means mounted on said vehicle to receive and retain said forwardly propelled stream of debris and to deposit the received and retained debris into said hopper;

a deflector flap means disposed forwardly of said rotating sweeping broom and immediately rearwardly of the debris accepting lower end portion of said mechanical debris elevating means, to receive at least a portion of said forwardly propelled stream of debris and to deflect it upwardly and forwardly onto said mechanical debris elevating means; and, air blast generating means in direct connection with a horizontally elongate air blast outlet of width ($W_O$) for effecting a blast of air that forcefully impinges said surface behind said leading edge, thereby propelling forwardly therewith fine debris disposed on said surface, and that carries forwardly through said rotating sweeping broom and egresses therefrom, to deflect forwardly and upwardly off said deflector flap means and forwardly past said deflector flap means to said mechanical debris elevating means.

2. The mechanical surface cleaning vehicle of claim 1, wherein said blast of air carries through said rotating sweeping broom exclusive of subsequent re-entry into the lower portion of said rotating sweeping broom below said horizontal axis of rotation, prior to reaching said mechanical debris elevating means.

3. The mechanical surface cleaning vehicle of claim 1, wherein said blast of air forcefully impinges said surface behind said leading edge and carries through said rotating sweeping broom to said mechanical debris elevating means exclusive of subsequent impingement of said surface, prior to reaching said mechanical debris elevating means.

4. The mechanical surface cleaning vehicle of claim 1, wherein said air blast outlet is disposed immediately rearwardly of said contacted portion of said surface.

5. The mechanical surface cleaning vehicle of claim 4, wherein said air blast outlet is positioned and oriented to aim said blast of air to impact at said contacted portion of said surface.

6. The mechanical surface cleaning vehicle of claim 4, wherein said air blast outlet is positioned and oriented to aim said blast of air to impact behind said contacted portion of said surface.

7. The mechanical surface cleaning vehicle of claim 4, wherein said width ($W_O$) of said horizontally elongate air blast outlet is substantially coincident with said width ($W_B$) of said rotating sweeping broom.

8. The mechanical surface cleaning vehicle of claim 1, wherein said blast of air carries forwardly through said rotating sweeping broom, and travels in a path having a forward component along its entire length, to said mechanical debris elevating means.

9. The mechanical surface cleaning vehicle of claim 1, wherein said blast of air forcefully impinges said surface in a substantially forward direction.

10. A mechanical surface cleaning vehicle having a front end, a back end, a debris retaining hopper, and defining a medial longitudinal axis (L), said surface cleaning vehicle comprising:

a cylindrically-shaped rotating sweeping broom of width ($W_B$) mounted on said vehicle for rotation about a horizontal axis of rotation and to propel forwardly from a surface contacting segment debris disposed on a contacted portion of a surface being cleaned, said contacted portion being defined at its front by a leading edge, thereby creating a forwardly propelled stream of debris;

mechanical debris elevating means mounted on said vehicle to receive and retain said forwardly propelled stream of debris and to deposit the received and retained debris into said hopper;

air blast generating means in direct connection with a horizontally elongate air blast outlet of width ($W_O$) for effecting a blast of air that forcefully impinges said surface behind said leading edge of said contacted portion thereby propelling forwardly therewith fine debris disposed on said surface, and that carries through said rotating sweeping broom and egresses therefrom to said mechanical debris elevating means, exclusive of subsequent re-entry into the lower portion of said rotating sweeping broom below said horizontal axis of rotation prior to reaching said mechanical debris elevating means.

11. The mechanical surface cleaning vehicle of claim 10, further comprising a deflector flap means disposed forwardly of said rotating sweeping broom and immediately rearwardly of the debris accepting lower end portion of said mechanical debris elevating means, wherein said blast of air carries forwardly through said rotating sweeping broom to deflect forwardly and upwardly off said deflector flap means and forwardly past said deflector flap means to said mechanical debris elevating means.

12. A mechanical surface cleaning vehicle having a front end, a back end, a debris retaining hopper, and defining a medial longitudinal axis (L), said surface cleaning vehicle comprising:

a cylindrically-shaped rotating sweeping broom of width ($W_B$) mounted on said vehicle for rotation about a horizontal axis of rotation and to propel forwardly from a surface contacting segment debris disposed on a contacted portion of a surface being cleaned, said contacted portion being defined at its front by a leading edge, thereby creating a forwardly propelled stream of debris;

mechanical debris elevating means mounted on said vehicle to receive and retain said forwardly propelled stream of debris and to deposit the received and retained debris into said hopper;

air blast generating means in direct connection with a horizontally elongate air blast outlet of width ($W_O$) for effecting a blast of air that forcefully impinges said surface behind said leading edge of said contacted portion thereby propelling forwardly therewith fine debris disposed on said surface, and that carries through said rotating sweeping broom and egresses therefrom to said mechanical debris elevating means, exclusive of subsequent impingement of said surface prior to reaching said mechanical debris elevating means.

13. A mechanical surface cleaning vehicle having a front end, a back end, a debris retaining hopper, and defining a medial longitudinal axis (L), said surface cleaning vehicle comprising:

a cylindrically-shaped rotating sweeping broom of width ($W_B$) mounted on said vehicle for rotation about a horizontal axis of rotation and to propel forwardly from a surface contacting segment debris disposed on a contacted portion of a surface being cleaned, said contacted portion being defined at its front by a leading edge, thereby creating a forwardly propelled stream of debris;

mechanical debris elevating means mounted on said vehicle to receive and retain said forwardly propelled stream of debris and to deposit the received and retained debris into said hopper;

air blast generating means in direct connection with a horizontally elongate air blast outlet of width ($W_O$) disposed immediately rearwardly of said contacted portion of said surface for effecting a blast of air that forcefully impinges said surface behind said leading edge of said contacted portion thereby propelling forwardly therewith fine debris disposed on said surface, and that carries forwardly through said rotating sweeping broom and egresses therefrom, to said mechanical debris elevating means.

14. A mechanical surface cleaning vehicle having a front end, a back end, a debris retaining hopper, and defining a medial longitudinal axis (L), said surface cleaning vehicle comprising:

a cylindrically-shaped rotating sweeping broom of width ($W_B$) mounted on said vehicle for rotation about a horizontal axis of rotation and to propel forwardly from a surface contacting segment debris disposed on a contacted portion of a surface being cleaned, said contacted portion being defined at its front by a leading edge, thereby creating a forwardly propelled stream of debris;

mechanical debris elevating means mounted on said vehicle to receive and retain said forwardly propelled stream of debris and to deposit the received and retained debris into said hopper;

air blast generating means in direct connection with a horizontally elongate air blast outlet of width ($W_O$) for effecting a blast of air that forcefully impinges said surface behind said leading edge of said contacted portion thereby propelling forwardly therewith fine debris disposed on said surface, and that carries forwardly through said rotating sweeping broom and egresses therefrom, and travels in a path having a forward component along its entire length, to said mechanical debris elevating means.

15. A mechanical surface cleaning vehicle having a front end, a back end, a debris retaining hopper, and defining a medial longitudinal axis (L), said surface cleaning vehicle comprising:

a cylindrically-shaped rotating sweeping broom of width ($W_B$) mounted on said vehicle for rotation about a horizontal axis of rotation and to propel forwardly from a surface contacting segment debris disposed on a contacted portion of a surface being cleaned, said contacted portion being defined at its front by a leading edge, thereby creating a forwardly propelled stream of debris;

mechanical debris elevating means mounted on said vehicle to receive and retain said forwardly propelled stream of debris and to deposit the received and retained debris into said hopper;

air blast generating means in direct connection with a horizontally elongate air blast outlet of width ($W_O$) for effecting a blast of air that forcefully impinges in a substantially forward direction said surface behind said leading edge of said contacted portion, thereby propelling forwardly therewith fine debris disposed on said surface, and that carries through said rotating sweeping broom and egresses therefrom, to said mechanical debris elevating means.

* * * * *